US005332945A

United States Patent [19]

True

[11] Patent Number: 5,332,945

[45] Date of Patent: Jul. 26, 1994

[54] PIERCE GUN WITH GRADING ELECTRODE

[75] Inventor: Richard B. True, Sunnyvale, Calif.

[73] Assignee: Litton Systems, Inc., Beverly Hills, Calif.

[21] Appl. No.: 881,041

[22] Filed: May 11, 1992

[51] Int. Cl.[5] ..... H01J 29/46; H01J 1/46

[52] U.S. Cl. ..... 313/452; 313/449; 313/414; 313/299; 313/300

[58] Field of Search ..... 313/452, 349, 449, 414, 313/299, 300

[56] References Cited

U.S. PATENT DOCUMENTS

| | | | |
|---|---|---|---|
| 3,697,795 | 10/1972 | Braun et al. . | |
| 3,852,633 | 12/1974 | Hunter . | |
| 3,886,399 | 5/1975 | Symons . | |
| 3,903,450 | 9/1975 | Forbess et al. | 313/452 |
| 3,906,280 | 9/1975 | Andelfinger et al. . | |
| 4,023,061 | 5/1977 | Berwick et al. | 313/349 |
| 4,145,635 | 3/1979 | Tuck | 313/299 |
| 4,553,064 | 11/1985 | Amboss . | |
| 4,583,021 | 4/1986 | Herriott et al. | 313/304 |
| 4,593,230 | 6/1986 | True | 313/349 |
| 4,737,680 | 4/1988 | True et al. | 313/349 |
| 4,780,684 | 10/1988 | Kosmahl | 330/54 |

FOREIGN PATENT DOCUMENTS

| | | |
|---|---|---|
| 854943 | 11/1960 | United Kingdom . |
| 906043 | 9/1962 | United Kingdom . |

OTHER PUBLICATIONS

Design of Electron Sources and Beam Transport Systems for Very High Power Microwaves Tubes; R. b. True; Litton Systems, Electron Devices Division, San Carlos, Calif. 94070, Jun. 10-15, 1990.

*Primary Examiner*—Donald J. Yusko
*Assistant Examiner*—Matthew J. Esserman
*Attorney, Agent, or Firm*—Graham & James

[57] ABSTRACT

A Pierce electron gun is provided having a cathode, a focusing electrode surrounding the cathode, and an anode disposed a fixed distance from the cathode and having an opening therethrough. The electron gun has at least one grading electrode disposed between the focusing electrode and the anode. The grading electrode controls shape of equipotential lines of an electric potential difference provided between the anode and the cathode, to purposely reduce field gradient levels formed by the electric potential difference. The grading electrode further has a double radial bend having an inner radial curve of a first radius and an outer radial curve of a second radius.

4 Claims, 1 Drawing Sheet

PIERCE GUN WITH GRADING ELECTRODE

BACKGROUND OF THE INVENTION

1. Field of the Invention

The present invention relates to an improved electron gun and, more particularly, to an improved gun configuration having reduced electrostatic gradients enabling higher operating voltage without breakdown.

2. Description of Related Art

It is well known in the art to utilize a linear beam device within a travelling wave tube (TWT), klystron, or other charged particle device. In a linear beam device, an electron beam originating from an electron gun is caused to propagate through a tunnel or drift tube generally containing an RF interaction structure. At the end of its travel, the electron beam is deposited within a collector or beam dump which effectively captures the spent electron beam. The beam must be focused by magnetic or electrostatic fields in the interaction structure of the device in order for it to be effectively transported from the electron gun to the collector without loss to the interaction structure.

In particular, a TWT is a broad-band, microwave tube which depends for its characteristics upon interaction between the electric field of a wave propagated along a wave guide and the electron beam travelling within the wave. In this tube, the electrons in the beam travel with velocities slightly greater than that of the wave, and, on the average, are slowed down by the field of the wave. Thus, the loss in kinetic energy of the electrons appears as an increased energy conveyed by the field to the wave. The TWT, therefore, may be used as an amplifier or an oscillator.

The electron gun which forms the electron beam typically comprises a cathode and an anode. The cathode includes an internal heater to raise the temperature of the cathode surface to a level sufficient for thermionic emission to occur. When the potential of the anode is positive with respect to the cathode, electrons are drawn from the cathode surface and move towards the anode. In space charged limited flow, beam current is determined by the strength of the electrostatic field at the cathode surface. The geometry of the cathode, anode, and a focusing electrode provide an electrostatic field shape which defines the flow pattern. The electronic flow passes through an opening in the anode, and into the TWT. An electron gun of this type is known as a Pierce gun.

It has long been desired to increase the beam power of the typical Pierce gun, since a more powerful beam could result in more power being transferred to the wave. The operating voltage of the gun is roughly proportional to the beam output power, and increasing the operating voltage has been suggested as a method of increasing the beam power. However, if the operating voltage is increased beyond a threshold determined by the peak negative field gradient, the field becomes susceptible to breakdown. A breakdown condition is catastrophic to both the gun and the TWT. During a breakdown, a high voltage arc bridges between the anode and the cathode or the focusing electrode, further causing plasma generation which could ignite and destroy the gun and the TWT. For example, a Pierce gun operating at 600 kv would have a peak negative gradient at the focus electrode of approximately 200 kv/cm. Although this design might be sufficient for short pulse operation in the range of 1 μsec, arcing would probably occur if the pulse length is extended to 5 μsecs and beyond.

One method of increasing the operating voltage of a Pierce gun entails partitioning the inter-electrode space with grading electrodes. This method has been described in R. True, "Design of Electron Sources and Beam Transport Systems for Very High Power Microwave Tubes," Proceedings of the Fifth National Conference on High Power Microwave Technology, United States Military Academy, West Point, N.Y., pp. 178–181, June 1990. In that paper, it was shown that with the use of grading electrodes along equipotential lines, the maximum voltage before breakdown increases substantially. Calculation of the maximum breakdown voltage in a Pierce gun is described in A. Staprans, "Electron Gun Breakdown," High Voltage Workshop, Monterey, Calif., February 1985, which provides the equation:

$$V=kL^{0.8}$$

where L is equal to minimum inter-electrode spacing. Factor k is pulse-length dependent and is approximately equal to $9\times10^6$, $6\times10^6$, $4\times10^6$, and $3\times10^6$, for 1, 5, 100 μsec pulses, and DC operation, respectively. For an inter-electrode space having n regions, the voltage breakdown for each region would be defined by the equation:

$$V'/n=k(L/n)^{0.8}$$

Therefore, V' would be equal to $Vn^{0.2}$. In sum, the total breakdown voltage with the inter-electrode spacing partitioned into n regions is greater than the original breakdown voltage of a non-partitioned gun.

In a gun using three grading electrodes (n=4), the maximum voltage before breakdown would increase by a factor of 1.32. In high-power klystrons, peak output power is roughly proportional to $PV^{2.5}$, where P equals perveance. For the three grading electrode example, maximum achievable power can be expected to double. Although this analysis neglects certain factors which can affect the high-voltage breakdown limit and the actual voltage and power increase may be less than double, it is nevertheless still very significant.

Nevertheless, high power applications continue to demand electron guns capable of producing increasing amounts of power. Thus, it would be desirable to provide a Pierce gun capable of producing increased beam power over that of a conventional gun using grading electrodes.

SUMMARY OF THE INVENTION

Accordingly, a principal object of the present invention is to provide a Pierce gun capable of producing increased beam power over that produced by a conventional Pierce gun utilizing grading electrodes.

In accomplishing these and other objects, there is provided a Pierce electron gun having a cathode, a focusing electrode surrounding the cathode, an anode disposed a fixed distance from the cathode and having an opening therethrough. At least one grading electrode is disposed between the focusing electrode and the anode. The grading electrode is shaped to control position of equipotential lines of an electric field provided in the inter-electrode space between the cathode and the anode, so as to purposely reduce field gradient levels formed by the electric field.

In a particular embodiment of the present invention, three grading electrodes would be used. Each grading electrode would have a double radial bend, comprising an outer radial curve of a first radius and an inner radial curve of a second radius. The grading electrodes would further have rounded ends.

A more complete understanding of the Pierce gun having grading electrodes of the present invention will be afforded to those skilled in the art, as well as a realization of additional advantages and objects thereof, by a consideration of the following detailed description of the preferred embodiment. Reference will be made to the appended sheets of drawings, which will first be described briefly.

DESCRIPTION OF THE PREFERRED EMBODIMENT

Figures 1, 2:
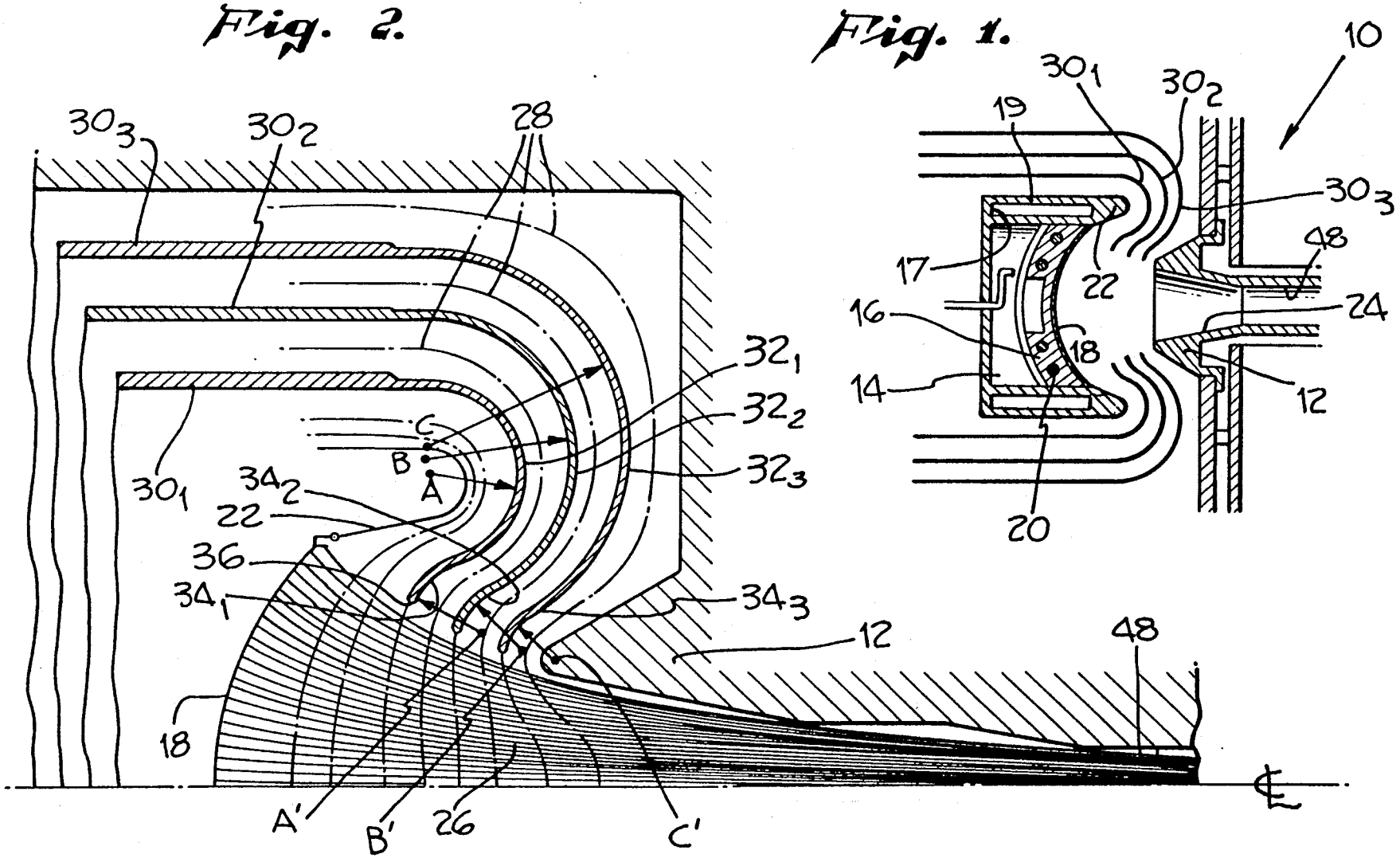
FIG. 1 is a sectional side view of a Pierce gun having grading electrodes of the present invention.
FIG. 2 is a side view of a Pierce gun having grading electrodes showing the equipotential lines and the laminar flow of electrons.

Referring now to the drawings, FIG. 1 shows an electron gun 10 having an anode 12 and a cathode housing assembly 16. The cathode housing assembly 16 secures to a gun support mount 14, and consists of a cathode having a smooth, concave electron emitting surface 18. The emitting surface is heated by an encapsulated heating coil 20. A focusing electrode 22 surrounds the outer circumference of the cathode assembly 16 and is physically isolated from the cathode assembly so that it remains cooler than the cathode. Heat shields 17 and 19 are provided to prevent the conduction of heat from the emitting surface 18 to the focusing electrode 22.

The anode 12 as an annular opening 24 axially disposed relative the emitting surface 18 of the cathode assembly 16. It should be understood that the anode 12 and cathode assembly 16 are symmetrically disposed about a center axis through the center of the anode and cathode.

As known in the art, electrons emitted from the smooth concave surface 18 of the cathode assembly 16 are accelerated towards the annular opening 24 in the anode 12. These emitting electrons combine into a beam, shown generally at 26 of FIG. 2. The beam can be modulated by alternating the voltage between the anode 12 and the emitting surface 18. The focusing electrode 22 acts to shape the electric field in the inter-electrode space between the cathode assembly 16 and the anode 12. In the inter-electrode space shown in FIG. 2, equipotential lines 28 are drawn which denote imaginary surfaces having constant electric potential.

In the present invention, a plurality of grading electrodes 30 are provided in the inter-electrode space between the anode 12 and the cathode assembly 16. The grading electrodes 30 are positioned to minimize the electric field gradient in the inter-electrode space, and as such control the position of the equipotential lines. The precise shape can be determined by computer simulation. As should be apparent from FIG. 2, the grading electrodes 30 do not necessarily follow the equipotential lines but instead form surfaces generally intersecting the lines, and have a double radial bend. The ends 36 of the grading electrodes 30 are generally rounded.

The double radial bend of grading electrodes $\mathbf{30_1}$, $\mathbf{30_2}$, and $\mathbf{30_3}$ comprises outer curves $\mathbf{32_1}$, $\mathbf{32_2}$, and $\mathbf{32_3}$, and inner curves $\mathbf{34_1}$, $\mathbf{34_2}$, and $\mathbf{34_3}$, respectively. The radius of curvature for each of the grading electrodes 30 in both the outer curve 32 and the inner curve 34 is determined by shifting center points adjacent to the focusing electrode 22 and the anode 12, respectively. The outer curve 32 of each of the grading electrodes 30 is formed along a radius having radial center points at A, B and C. The innermost grading electrode $\mathbf{30_1}$ corresponds with a radial center point A which is substantially centered within the focusing electrode 22. The outer curve $\mathbf{32_2}$ of the second grading electrode $\mathbf{30_2}$ has a radial center point B which is also provided within the focusing electrode 22, but closer to the outer edge of the focusing electrode. The outermost grading electrode $\mathbf{30_3}$ has an outer curve $\mathbf{32_3}$ determined by radial center point C which lies beyond the focusing electrode 22 in the inter-electrode space.

Similarly, the inner curve $\mathbf{34_1}$ of the innermost grading electrode $\mathbf{30_1}$ is determined from a radial center point A' which lies on an equipotential line 28 substantially centered within the inter-electrode space. The second grading electrode $\mathbf{30_2}$ has an inner curve $\mathbf{34_2}$ determined by radial center point B' which also lies on a equipotential line 28, but closer to the anode 12 within the inter-electrode space. Lastly, the outermost grading electrode $\mathbf{30_3}$ has an inner curve $\mathbf{34_3}$ formed from a radial center point C' which is substantially centered within the anode 12.

It is anticipated that the grading electrodes be formed from cylinders of non-magnetic metallic material. The double radial bends can be readily formed by known manufacturing techniques, such as by spinning. This type of structure would be inherently mechanically stiff and rugged. In a preferred embodiment, the electrodes could be formed from concentric cylinders of stainless steel and copper. The cylinders are integrally formed together using known welding techniques. The stainless steel portion would face outward, toward the anode 12, while the copper would face inward. Oxidized stainless steel is a preferred material for the grading electrodes since it has good high voltage stand-off characteristics. The copper has good thermal characteristics for heat removal from the grading electrodes. Alternatively, depleted uranium or molybdenum could also be used in place of stainless steel.

Computer modeling has shown that the use of three grading electrodes 30 having the double radial bend would reduce the maximum negative gradient to approximately 170 kv/cm, or a 15% reduction in the peak negative gradient. This would translate to a potential achievable power increase of three times over the non-grading electrode Pierce electron gun case. At an operating voltage of 600 kv, the present invention would be capable of operating reliably at the five μsec pulse length level and beyond.

Having thus described an preferred embodiment of a Pierce gun having grading electrodes, it should now be apparent to those skilled in the art that the aforestated objects and advantages for the within system have been achieved. It should also be appreciated by those skilled in the art that various modifications, adaptations and alternative embodiments thereof may be made within the scope and spirit of the present invention. For example, although a Pierce gun having three grading electrodes has been shown, it should be apparent that other numbers of grading electrodes can be advantageously utilized.

The present invention is further defined by the following claims:

What is claimed is:

1. An electron gun having a cathode, a focusing electrode adjacent the cathode, and an anode disposed a fixed distance from said cathode, the electron gun further comprising:

at least one grading electrode disposed between said focusing electrode and said anode as to be non-coincident with equipotential lines of an electric potential difference provided between said cathode and said anode, the grading electrode controlling position of said equipotential lines to reduce surface field gradient levels formed by said electric potential difference.

2. The electron gun of claim 1, wherein said at least one grading electrode comprises a metallic non-magnetic cylinder.

3. The electron gun of claim 2, wherein said at least one grading electrode is further comprised of a concentric fused cylinder of stainless steel and copper.

4. A pierce electron gun having a cathode, a focusing electrode surrounding the cathode, and an anode disposed a fixed distance from said cathode having an opening therethrough, the electron gun further comprising:

three grading electrodes disposed between said focusing electrode and said anode, the grading electrodes being non-coincident with equipotential lines of an electric potential difference provided between said cathode and said anode to reduce surface field gradient levels formed by said electric potential difference, said grading electrodes having a double radial bend including an outer radial curve of a first radius and an inner radial curve of a second radius;

wherein, said grading electrodes have substantially rounded ends, and wherein said grading electrodes are comprised of metallic non-magnetic cylinders.

* * * * *